US006132920A

United States Patent [19]

Hagi et al.

[11] Patent Number: 6,132,920

[45] Date of Patent: Oct. 17, 2000

[54] TONER FOR DEVELOPING ELECTROSTATIC LATENT IMAGE

[75] Inventors: Masayuki Hagi, Mino; Junichi Tamaoki, Sakai; Takeshi Arai, Akashi; Megumi Aoki, Itami, all of Japan

[73] Assignee: Minolta Co., Ltd., Osaka, Japan

[21] Appl. No.: 09/435,623

[22] Filed: Nov. 8, 1999

[30] Foreign Application Priority Data

Dec. 4, 1998 [JP] Japan ..... 10-345380

[51] Int. Cl.[7] ..... G03G 9/097

[52] U.S. Cl. ..... 430/110; 430/111

[58] Field of Search ..... 430/110, 111

[56] References Cited

U.S. PATENT DOCUMENTS

| | | | |
|---|---|---|---|
| 4,623,605 | 11/1986 | Kato et al. | 430/110 |
| 5,155,000 | 10/1992 | Matsumura et al. | 430/110 |
| 5,192,637 | 3/1993 | Saito et al. | 430/109 |
| 5,272,040 | 12/1993 | Nakasawa et al. | 430/110 |
| 5,429,902 | 7/1995 | Saito et al. | 430/110 |
| 5,604,071 | 2/1997 | Okado et al. | 430/110 |
| 5,705,303 | 1/1998 | Ichimura et al. | 430/110 |
| 5,747,211 | 5/1998 | Hagi et al. | 430/110 |
| 5,840,458 | 11/1998 | Kido et al. | 430/110 |
| 5,853,938 | 12/1998 | Nakazawa et al. | 430/111 |

*Primary Examiner*—Roland Martin

*Attorney, Agent, or Firm*—Burns, Doane, Swecker & Mathis, LLP

[57] ABSTRACT

The present invention relates to a toner comprising:

toner particles containing a binder resin and a colorant; and an external addition agent that is admixed with the toner particles, the external addition agent comprising titanium oxide particles which are produced through a vapor-phase oxidizing method and has a number-average particle size of 0.1 to 0.7 $\mu$m.

28 Claims, No Drawings

TONER FOR DEVELOPING ELECTROSTATIC LATENT IMAGE

This application is based on application(s) No. Hei 10-345380 filed in Japan, the contents of which are hereby incorporated by reference.

BACKGROUND QF THE INVENTION

1. Field of the Invention

The present invention relates to a toner for developing an electrostatic latent image formed on an electrostatic latent image-supporting member.

2. Description of the Related Art

Conventionally, an image-forming method in which an electrostatic latent image formed on an electrostatic latent-image-supporting member such as a photosensitive member is developed by toner and the toner images are transferred onto a recording medium such as recording paper has been widely used in copying machines, printers, facsimiles, etc. This method has also been adopted in full-color image-forming apparatuses for reproducing a multi-color image by superposing plural color toners.

For such electrostatic latent image-developing toners used in various image-forming apparatuses, various characteristics are required so as to meet respective demands. For example, in an image-forming apparatus of the digital system, the area gradation system and the laser intensity modulation system have been adopted as a multi-gradation image-reproducing system. In both of the systems, toners having a high fluidity are required so as to reproduce images with superior gradation. In particular, in the laser intensity modulation system, a higher fluidity is required since reproduction with high gradation is carried out by changing the quantity of adhesion of toner in accordance with a difference in electric charges of latent images resulting from the modulation of the laser intensity.

However, there are various technical problems to be overcome in order to satisfy the above-mentioned characteristics. For example, in order to improve the fluidity, it is effective to externally add a fluidizing agent, such as silica fine particles and titanium oxide fine particles, to the toner, and to increase the amount of addition of the fluidizing agent. However, when the addition amount of the external addition agent increases, the amount of the external addition agent that passes through the cleaning blade, adheres to and is fixed to the surface of the photosensitive member also increases, resulting in such a serious problem that other toner components adhere to and are fixed to the photosensitive member with the external addition agent forming a core at the time of cleaning (which is referred to as BS (black spot) problem). In contrast, when the quantity of the external addition agent is reduced so as to prevent the occurrence of BS, the fluidity becomes insufficient, and toner aggregation occurs due to stress, etc. within the developing device during the repetition of printing processes, resulting in a problem of white voids in solid images.

A technique has been proposed in which, in order to prevent the occurrence of adhering and fixing (BS) to the photosensitive member, titanium oxide having a comparatively large particle size (grinding agent) (number average particle size: 1 to 3 $\mu$m) are admixed with toner particles together with the above-mentioned fluidizing agent. With respect to the titanium oxide, it is general to use titanium dioxide particles produced by depositing titanium hydroxide in a titanium (IV) salt solution and calcing the deposited titanium hydroxide so as to obtain titanium oxide particles to be used. However, the toner obtained by the above-mentioned technique raises the problem of damaging the photosensitive member at the time of cleaningbytheuseof abladeduringrepeatedimage-formingprocesses, or at the time of transferring process by the pressed transferring drum in a full-color image-forming apparatus, etc. When the photosensitive member has been scratched, the blade cleaning process does not function properly, resulting in captured external addition agent and toner components and accumulation thereof. This tends to raise serious problems such as noise in the resulting images.

SUMMARY OF THE INVENTION

The present invention is to provide an electrostatic latent image-developing toner which can prevent occurrence of white voids in copied images, adhesion of toner components onto the photosensitive member and scratches on the photosensitive member.

The present invention relates to an electrostatic latent image-developing toner comprising:

toner particles containing a binder resin and a colorant; and an external addition agent that is admixed with the toner particles, the external addition agent comprising titanium oxide particles which are produced through a vapor-phase oxidizing method and has a number-average particle size of 0.1 to 0.7 $\mu$m.

DETAILED DESCRIPTION OF THE INVENTION

The present invention provides a toner comprising:

toner particles containing a binder resin and a colorant; and an external addition agent that is admixed with the toner particles, the external addition agent comprising titanium oxide particles which are produced through a vapor-phase oxidizing method and has a number-average particle size of 0.1 to 0.7 $\mu$m.

The external addition agent admixed with the toner particles in the present invention comprises titanium oxide particles having a number average particle size in the range of 0.1 to 0.7 $\mu$m, preferably 0.3 to 0.6 $\mu$m obtained by the vapor phase oxidizing method. The application of such titanium oxide particles makes it possible to solve, for example, the above-mentioned problem of BS without causing adverse effects such as scratches on the photosensitive member and degradation in the toner fluidity caused by addition of metal oxide fine particles used as a fludizing agent. The number average particle size of the titanium oxide particles smaller than 0.1 $\mu$m makes the effects of preventing BS insufficient. The number average particle size greater than 0.7 $\mu$m gives adverse effects to the light-transmitting properties of a toner when it is used as a light-transmitting color toner, or tends to make the particles easily separate from the toner particle surface, with the result that they might damage the photosensitive member at the time of blade cleaning in the case of repeated image-forming processes, or at the time of the transferring process in a pressed state by the transfer drum in a full-color image-forming apparatus, etc.

The titanium oxide particles to be added as the external addition agent in the present invention are manufactured by a vapor-phase oxidizing method. For example, titanium tetrachloride, obtained by a chloride method, is oxidized in a vapor phase so that the particles are obtained. More specifically, for example, an ore, such as rutile, is mixed with coke, charcoal, etc., and pulverized. Chloride gas is introduced into the mixture while heated to about 800° C., so that $TiCl_4$ is distilled. The obtained $TiCl_4$ is heated to about 650° C. or more together with dry oxygen gas to give titanium oxide particles.

Since the titanium oxide particles, used in the toner of the present invention, are obtained through the vapor-phase oxidizing method, the product contains few bulky aggregated particles because of the inherent characteristic of its manufacturing method, and the primary particles have particle sizes in the range of 50 to 500 nm, and have an irregular polyhedron shape. When such titanium oxide particles obtained by the vapor-phase oxidizing method (hereinafter, referred to as vapor-phase-method titanium oxide particles) are externally added to and blended in toner particles, the primary particles exist in a state in which a few particles of them are joined together. However, since aggregated particles not less than 1 $\mu$m hardly exist, the titanium oxide particles can be dispersed on the surface of toner particles comparatively uniformly without being separated and isolated from the toner particles. Moreover, since the crystal structure of the vapor-phase-method titanium oxide particles is of the rutile type, the particles have a hardness higher than those of the anatase type or amorphous type, they are superior in grinding properties. In the present invention, the titanium oxide particles having comparatively small particle sizes and a superior grinding properties are allowed to adhere to the surface of toner particles uniformly. Therefore, it is possible to improve the function of preventing other fine particles from escaping through the blade at the time of blade cleaning, and consequently to improve the effect of preventing BS.

Furthermore, as compared with titanium oxide particles obtained a method other than the vapor-phase method, the vapor-phase-method titanium oxide particles have a very sharp particle size distribution; therefore, aggregated and sintered-bulky particles hardly exist. For this reason, the toner of the present invention makes it possible to prevent scratches on the photosensitive member at the time of blade cleaning in the case of repeated image forming processes, or at the time of the transferring process in a pressed state by the transfer drum in a full-color image-forming apparatus, etc. The problem of scratches on the photosensitive member becomes particularly serious when bulky particles of not less than 1 $\mu$m are contained in the titanium oxide particles at not less than 20% by number. In the case of the vapor-phase-method titanium oxide particles, since the content of such bulky particles is approximately not more than 5% by number, the toner of the present invention makes it possible to prevent the above problem. The particle size distribution of the vapor-phase-method titanium oxide particles can be controlled within a range of 50 to 1000 nm.

The above-mentioned vapor-phase-method titanium oxide particles used in the toner of the present invention are preferably subjected to a surface treatment by a hydrophobic agent. The application of the vapor-phase-method titanium oxide particles that have been subjected to the hydrophobic treatment makes it possible to improve the toner's environmental stability. More preferably, the hydrophobic titanium oxide particles having a degree of hydrophobicity of not less than 50% are used. If the degree of hydrophobicity is less than 50%, the electrification quantity of the toner is reduced under high moisture environments because of hydroscopicity of titanium oxide particles, resulting in a problem of fog, etc.

The surface treatment method for the titanium oxide particles by the use of a hydrophobic agent is not particularly limited, and known methods may be adopted. For example, the following methods, etc. may be adopted: a dry method in which a hydrophobic agent is diluted by a solvent and the diluted liquid is added to the fine particles, and mixed, and the mixed materials are heated and dried, and then pulverized; and a wet method in which the fine particles are dispersed in an aqueous system so as to form a slurry, and to this is added and blended a hydrophobic agent, and this is heated and dried, and then pulverized. In the present invention; it is preferable to carry out the hydrophobic treatment in an aqueous system from the view point of uniformity in the surface treatment by the hydrophobic agent, the aggregation-preventing properties of the titanium oxide particles, etc.

The degree of hydrophobicity in the present invention is measured by a methanol wettability method. First, methanol is dripped into water in which a sample is dispersed. The weight of methanol required for moistening all the sample is measured. The weight of methanol in water and methanol is represented by a percentage, which is used to express the degree of hydrophobicity.

With respect to the hydrophobic agent, known treatment agents which have conventionally been used for hydrophobic treatments for metal particles may be adopted. For example, silane coupling agents, titanate coupling agents, silicone oil, silicone varnish, etc. are applicable. Examples of the silane coupling agents include: hexamethyldisilazane, trimethylsilane, trimethylchlorosilane, dimethyldichlorosilane, methyltrichlorosilane, allyldimethylchlorosilane, benzyldimethylchlorosilane, methyltrimethoxysilane, methyltriethyoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-butyltrimethoxysilane, n-hexadecyltrimethoxysilane, n-octadecyltrimethoxysilane, vinyltrimethoxysilane, vinyltriethoxysilane, γ-methacyloxypropyltrimethoxysilane, vinyltriacetoxysilane, etc. With respect to the silicone oil, examples thereof include: dimethylpolysiloxane, methylhydrogen polysiloxane, methylphenylpolysiloxane, etc.

In the toner of the present invention, the above-mentioned titanium oxide particles are contained at 0.3 to 4.5% by weight, preferably 0.5 to 3.6% by weight, to the toner particles. The content less than 0.3% by weight makes the effect of preventing BS insufficient, and the content exceeding 4.5% by weight is not preferable because of increased adverse effects on the toner chargeability.

In the toner of the present invention, together with the above-mentioned titanium oxide particles, metal oxide fine particles, which have a number average particle size of 10 to 90 nm and have been subjected to a surface treatment by a hydrophobic agent, may be externally admixed with the toner particles. With respect to the metal oxide fine particles, fine particles, such as silica, titanium oxide and alumina, may be applied solely or in combination. The metal oxide fine particles can provide functions such as an improvement in the toner fluidizing properties, an improvement in the environmental stability and prevention of white voids.

The degree of hydrophobicity of the metal oxide fine particles is preferably set to not less than 50%. By using such metal oxide fine particles that have been subjected to a hydrophobic treatment, it becomes possible to prevent a reduction in the quantity of toner electrification even under high temperature, high moisture conditions. With respect to the treatment method and the hydrophobic agent for the hydrophobic treatment to the metal oxide fine particles, the same treatment methods and hydrophobic agents as used in the hydrophobic treatment for the vapor-phase titanium oxide fine particles may be used. The measuring method for the degree of hydrophobicity of the metal oxide fine particles is the same as the above-mentioned measuring method.

In the toner of the present invention, a content of the metal oxide fine particles with respect to the toner particles is 0. 1 to 4.0% by weight, preferably 0.2 to 3.6% by weight. The content less than 0.1% by weight makes the effects of the addition insufficient. The content exceeding 4.0% by weight tends to cause BS. In particular, when the metal oxide fine particles are added, it is more preferable to set the content at not less than 1.0% by weight, from the viewpoint of an improvement in the fluidizing properties and the prevention of white voids. When two or more kinds of the metal oxide fine particles are contained, the total of the contents of them is set in the above-mentioned range.

With respect to metal oxide fine particles that are preferably used from the viewpoint of an improvement in the fluidizing properties and the prevention of a reduction in the electrification quantity of the toner under high temperature and high moisture environments, it is desired to use those metal oxide fine particles that have a number average particle size in the range of 10 to 30 nm, preferably 10 to 25 nm, and also have a degree of hydrophobicity of not less than 50%; in particular, silica fine particles having such physical properties are preferably used.

From the viewpoint of an improvement in the environmental stability, in particular, from the viewpoint of the prevention of a reduction in the image density due to charging-up under low temperature, low moisture environments, it is desired to use titanium oxide fine particles that have a number average particles size in the range of 10 to 90 nm, preferably 30 to 80 nm, and these titanium oxide fine particles are also preferably set to have a degree of hydrophobicity of not less than 50% from the viewpoint of the environmental stability. With respect to the titanium oxide fine particles, anatase-type titanium oxide, rutile-type titanium oxide, amorphous titanium oxide, etc. are applicable. Among these titanium oxides, anatase-type titanium oxide is preferably used.

With respect to the above-mentioned metal oxide fine particles, from the viewpoint of prevention of white voids, an improvement in the heat resistance and maintenance properties, etc., it is desired to use metal oxide fine particles that have a number average particles size in the range of 30 to 90 nm, preferably 40 to 80 nm. These metal oxide fine particles are also preferably set to have a degree of hydrophobicity of not less than 50% from the viewpoint of the environmental stability.

From the viewpoints as described above, in the toner of the present invention, two kinds or more of the fine particles having different functions as described above may be used as the metal oxide fine particles in combination with the vapor-phase-method titanium oxide particles. The combination of the silica fine particles of 10 to 30 nm and the titanium oxide fine particles of 10 to 90 nm is preferably used, and more preferably, the combination of silica particles of 10 to 25 nm and titanium oxide fine particles of 30 to 80 nm is used.

With respect to the externally adding processes of the vapor-phase-method titanium oxide particles and the metal oxide fine particles to the toner particles, a mixing machine such as Henschel Mixer may be used to mix them. In the case when the metal oxide fine particles are used in combination, it is desirable to carry out a mixing process of the vapor-phase-method titanium oxide of the present invention after the toner particles and the metal oxide fine particles have been first mixed. Moreover, in the case when two kinds or more of the metal oxide fine particles are used, it is preferable to first mix the metal oxide fine particles having the highest electrification properties with the toner particles, and then to mix the other metal oxide fine particles and the vapor-phase-method titanium oxide particles with the toner particles, or to mix the other metal oxide fine particles and then mix the hydrophobic titanium oxide fine particles thereto.

In the toner of the present invention, the toner particles contain at least a binder resin and a colorant, and may optionally contain desired additives such as a charge-controlling agent, magnetic powder and wax.

With respect to the manufacturing method of the toner particles, known methods that have been conventionally used to produce toner particles may be adopted; and it is not particularly limited. Methods, such as a kneading and pulverizing method, a spray-drying method, a suspension polymerization method and an interface polymerization method (capsule toner), may be adopted so as to produce them.

In the present invention, with respect to resins to be used as the binder resin, known resins may be used, and styrene resins, acrylic resins such as alkylacrylate and alkylmethacrylate, styrene-acrylic copolymer resins, polyester resins, silicone resins, olefin resins, amide resins or epoxy resins are preferably used. In the case of full-color toners, in order to improve the OHP light-transmitting properties and the color reproducibility for superposed images, resins having high transparency and sharp melting properties and a low viscosity are required. With respect to the binder resin having such properties, polyester resins are preferably used.

With respect to the binder resin used-for full color toners such as cyan toner, magenta toner and yellow toner in the present invention, those resins having the following properties are preferably used: a number-average molecular weight (Mn) of 3000 to 6000, preferably 3500 to 5500, a ratio Mw/Mn of weight-average molecular weight (Mw) to number-average molecular weight (Mn) of 2 to 6, preferably 2.5 to 5.5, a glass transition point of 50 to 70° C., preferably 55 to 70° C., and a softening point of 90 to 110° C., preferably 90 to 105° C.

The number-average molecular weight less than 3000 of the inder resin tends to cause image defects (degradation in fixing roperties at the time the sheet is bent) due to separation of image portions when a full-color solid image is bent. The number-average molecular weight exceeding 6000 causes deterioration in the thermal fusing properties with the result that the fixing strength is lowered. The value of Mw/Mn smaller than 2 tends to cause high-temperature offset. The value exceeding 6 tends to cause deterioration in the sharp melting properties at the time of fixing, resulting in deterioration in the toner light-transmitting properties and the color-mixing properties at the time of a full-color image-formation. The glass transition point lower than 50° C. makes the heat resistant properties of the toner insufficient, making the toner susceptible to aggregation at the time of storing. The glass transition point higher than 75° C. causes deterioration in the fixing properties as well as deterioration in the color-mixing properties at the time of a full-color image formation. The softening point lower than 90° C. tends to cause high-temperature offset, and the value exceeding 110C tends to cause deterioration in the fixing strength, the light-transmitting properties, the color-mixing-properties and the gloss properties in full-color images.

The colorants used in the present invention are not particularly limited, and known pigments and dyes may be adopted. Examples thereof include carbon black, aniline blue, Chalco Oil Blue, chrome yellow, ultramarine blue, DuPont Oil Red, quinoline yellow, methylene blue chloride, copper phthalocyanine, Malachite green oxalate, Lump Black, Rose Bengal, C.I. Pigment Red48:1, C.I. Pigment Red 122, C.I. Pigment Red 57:1, C.I. Pigment Red 184, C.I. Pigment Yellow 97, C.I. Pigment Yellow 12, C.I. Pigment Yellow 17, C.I. Solvent Yellow 162, C.I. Pigment Blue 15:1, C.I. Pigment Blue 15:3, etc. When the toner of the present invention is used as a magnetic toner, some or all amount of the colorant may be replaced by a magnetic material. Examples of such a magnetic material include magnetite, ferrite, iron power, nickel, etc.

The colorant to be used in the color toner is preferably dispersed in the binder resin by a master batch process or a flushing process. The content of the colorant is preferably set to 2 to 15 parts by weight with respect to 100 parts by weight of the binder resin.

In the toner of the present invention, not particularly limited, known charge-control agents may be used. With respect to the negative charge-control agent used for color toners, colorless, white or light-colored charge-control agents, which do not give adverse effects on the tone and the light-transmitting properties of the color toner, may be applied. Examples thereof include metal complexes of zinc and chromium of salicylic acid derivatives, calix arene compounds, organic boron compounds, quaternary ammonium salt compounds containing fluoride, etc. With respect to the metal complex of salicylic acid derivative, for example, those disclosed in Japanese Patent Application Laid-Open No. Sho 53-127726, Japanese Patent Application Laid-Open No. Sho 62-145255, etc. may be adopted. With respect to calix arene compounds, for example, those disclosed in Japanese Patent Application Laid-Open No. Hei 2-201378, etc. may be adopted. With respect to organic boron compounds, for example, those disclosed in Japanese Patent Application Laid-Open No. Hei 2-221967, etc. may be adopted. With respect to quaternary ammonium salt compounds, for example, those disclosed in Japanese Patent Application Laid-Open No. Hei 3-1162, etc. may be adopted.

When such a charge-control agent is added, a content of the charge-control agent is preferably in the range of 0.5 to 5 parts by weight with respect to 100 parts by weight of the binder resin.

A wax may be added to the toner of the present invention in order to improve characteristics such as anti-offset properties. With respect to the wax, examples thereof include: polyethylene wax, polypropylene wax, carnauba wax, rice wax, sazol wax, montan ester waxes, Fischer-Tropsch wax, etc. When such a wax is added to the toner, a content is preferably set in the range of 0.5 to 5 parts by weight to 100 parts by weight of the binder resin. Thereby, it becomes possible to obtain the effects of the addition without causing disadvantages, such as filming.

It is preferable to adjust a volume-average particle size of the toner particles of the present invention to the range of 5 to 10 $\mu$m, preferably 6 to 9 m from the viewpoint of image reproducibility with high precision.

The toner of the present invention is not only capable of preventing white voids on copied images, adhesion of the toner components to the photosensitive member and scratches on the photosensitive member, but also superior-in the environmental stability and fluidity.

The toner of the present invention is applicable as a two-component developing toner used in combination with a carrier, or as a mono-component developing toner used without a carrier.

With respect to the carrier used in combination with the toner of the present invention, known carriers conventionally used as carriers for the two-component developing process may be adopted. For example, carriers made of magnetic particles such as iron and ferrite, resin-coated carriers made by coating these magnetic particles with a resin, or binder-type carriers made by dispersing magnetic fine particles in a binder resin, may be adopted. Among these carriers, resin-coated carriers which are coated with a silicone resin, a copolymer resin (graft resin) of organopolysiloxane with a vinyl monomer, or a polyester resin are preferably used from the viewpoint of anti-spent properties, etc. In particular, carriers coated with a resin obtained by allowing isocyanate to react with a copolymer resin of organopolysiloxane with a vinyl monomer are preferably used from the viewpoint of durability, environmental stability and anti-spent properties. With respect to the vinyl monomer, it is necessary to use a monomer with a substituent such as a hydroxyl group that is reactive to isocyanate. The volume-average particle size of the carrier is preferably set in the range of 20 to 100 $\mu$m, preferably 20 to 60 $\mu$m, from the viewpoint of high image-quality and prevention of carrier fog.

EXAMPLES

The following description will discuss the present invention in detail by means of examples; however, the present invention is not intended to be limited thereby.

(Preparation of toner base particles)

(Magenta master batch)

| | |
|---|---|
| Bisphenol polyester resin<br>(Tg: 58° C., Tm: 100° C., Mn: 4000, Mw/Mn: 2.5) | 70 parts by weight |
| Magenta pigment (C.I. Pigment Red 184) | 30 parts by weight |

A mixture having the above composition was fed into a pressure kneader, and mixed and kneaded. After cooled, the resultant kneaded materials were pulverized by a feather mill, to give a pigment master batch.

(Toner base particles 1)

| | |
|---|---|
| Above-mentioned polyester resin | 93 parts by weight |
| Above-mentioned master batch | 10 parts by weight |

The materials having the above-mentioned composition were sufficiently mixed by Henschel Mixer, and the mixture was then kneaded by a bent twin screw kneader. The resultant kneaded materials were cooled, and then coarsely pulverized by a feather mill, finely pulverized by a jet mill, and further classified so that toner base particles 1 having a volume-average particle size of 8.5 $\mu$m were obtained.

(Preparation of hydrophobic titanium oxide particles A)

A mixture of purified titanium tetrachloride obtained by the chloride method and oxygen gas was introduced to a vapor-phase oxidation reactor, and allowed to react at 1000° C. in a gaseous phase so that rutile-type titanium oxide bulk was obtained. The resultant titanium oxide bulk was pulverized by a hammer mill in a dry state, washed, dried at 110° C., and then pulverized by a jet mill to give titanium oxide particles. The particles size of these particles was measured by means of TEM photographing process to give a number-average particle size of 0.6 $\mu$m. The resultant titanium oxide particles were dispersed in an aqueous system so as to form a slurry. N-butyltrimethoxysilane was added and mixed with the slurry so as to be contained at 5% with respect to the titanium oxide particles. The admixture was dried and pulverized to give hydrophobic titanium oxide particles A having a degree of hydrophobicity of 60%.

(Preparation of hydrophobic titanium oxide particles B)

The same manufacturing processes as those of particles A were carried out except that the reaction temperature was set to 700° C. in the production process of the particles A, so that hydrophobic titanium oxide particles B having a number-average particle size of 0.2 μm was obtained.

(Preparation of hydrophobic titanium oxide particles C)

The same manufacturing processes as those of particles A were carried out except that the reaction temperature was set to 1200° C. in the production process of the particles A, so that hydrophobic titanium oxide particles C having a number-average particle size of 0.8 μm was obtained.

(Preparation of hydrophobic titanium oxide particles D)

A solution of titanium sulfate, obtained by the sulfuric acid method, was diluted with water. While the diluted solution was heated, titanyl sulfate salt was crystallized. This titanyl sulfate salt was further dissolved in water, and subjected to hydrolysis with heat so as to deposit titanium hydroxide. Titanium hydroxide was calcined at 1000° C. to give rutile-type titanium oxide bulk. The resultant titanium oxide bulk was pulverized by a hammer mill in a dry state, washed, dried at 110° C., and then further pulverized by a jet mill to give titanium oxide particles. The particles size of these particles was measured by means of TEM photographing process to give a number-average particle size of 0.5 μm. The resultant titanium oxide particles were dispersed in an aqueous system so as to form a slurry. N-butyltrimethoxysilane was added and mixed with the slurry so as to be contained at 5% with respect to the titanium oxide particles. The admixture was dried and pulverized to give hydrophobic titanium oxide particles D having a degree of hydrophobicity of 60%.

Example 1

(Toner 1)

| | |
|---|---|
| Toner base particles 1 | 100 parts by weight |
| Hydrophobic silica H2000 (made by Clariant K.K.) Number-average particle size 15 nm | 1 part by weight |

The above materials were put into Henschel Mixer, and mixed for three minutes under the condition of a peripheral velocity of 40 m/s at the tip of the blade. Hydrophobic titanium oxide particles A of 0.8 parts by weight were added to the mixture, mixed for one minute, and sieved by a round vibration sieve shaker with a 200 mesh screen to give toner 1.

Example 2

(Toner 2)

Toner 2 was obtained in a manner similar to Example 1, except that hydrophobic titanium oxide particles B were admixed externally instead of the hydrophobic titanium oxide particles A.

Example 3

(Toner 3)

Under the same conditions as Example 1 except that hydrophobic silica H2000 was changed to the material (titanium oxide E) obtained by subjecting anatase-type titanium oxide particles having a number-average particle size of 50 nm to a surface treatment with 10% n-butyltrimethoxysilane in a water wet system, the external addition agents were added and mixed, so that toner 3 was obtained.

Example (Toner 4)

Toner 4 was obtained in a manner similar to Example 1, except that 2.5 parts by weight of hydrophobic titanium oxide particles A were admixed externally.

Example 5

(Toner 5)

Toner 5 was obtained in a manner similar to Example 1, except that 2.5 parts by weight of hydrophobic silica H2000 was admixed externally.

Comparative Example 1

(Toner 6)

Toner 6 was obtained in a manner similar to Example 1, except that hydrophobic titanium oxide particles C were added externally instead of hydrophobic titanium oxide particles A.

Comparative Example 2

(Toner 7)

Toner 7 was obtained in a manner similar to Example 1, except that hydrophobic titanium oxide particles D were added externally instead of hydrophobic titanium oxide particles A.

Example 6

(Toner 8)

Toner 8 was obtained in a manner similar to Example 1, except that 3.5 parts by weight of hydrophobic titanium oxide particles A were admixed externally.

Example 7

(Toner 9)

Toner 9 was obtained in a manner similar to Example 1, except that 3.5 parts by weight of hydrophobic silica H2000 was admixed externally.

Example 8

(Toner 10)

Toner 10 was obtained in a manner similar to Example 1, except that 3.5 parts by weight of hydrophobic silica H2000 and 3.5 parts by weight of hydrophobic titanium oxide particles A were admixed externally.

Example 9

(Toner 11)

Toner 11 was obtained in a manner similar to Example 1, except that 0.3 parts by weight of hydrophobic silica H2000 and 0.3 parts by weight of hydrophobic titanium oxide particles A were admixed externally.

(Preparation of carrier 1)

To a 500 ml flask provided with a stirrer, a condenser, a thermometer, a nitrogen inlet tube and a dripping device was loaded 100 parts by weight of methylethylketone. To 100 parts by weight of methylethylketone were dissolved 36.7 parts by weight of methylmethacrylate, 5.1 parts by weight of 2-hydroxyethylmethacrylate, 58.2 parts by weight of 3-methacryloxypropyltris (trimethylsiloxy) silane and 1 part by weight of 1,1'-azobis (cyclohexane-1-carbonitrile) at 80° C. under a nitrogen atmosphere. The solution thus obtained was dripped into the reactor flask for two hours, and matured for 5 hours.

To the resin thus obtained was added an isophoronediisocyanate/trimethylolpropane adduct (IPDI/TMP series: NCO%=6.1%) so as to adjust the OH/NCO mole ratio to 1/1. The resulting solution was diluted with methylethylketone to give a coat resin solution having a solid ratio of 3% by weight.

By using calcined ferrite powder F-300(volume-average particle size: 50 μm, made by Powdertech K.K.) as a core material, the coat resin solution was applied thereto and dried by Spira Cota (made by Okada Seiko K.K.) so that an amount of coating resin to the core material was set at 1.5% by weight.

The resultant carrier was left in a hot-air circulating oven for one hour at 160° C. so as to be calcined. After cooled, the ferrite powder bulk was pulverized by a sieve shaker having screen meshes of 106 μm openings and 75 μm openings to give resin-coated carrier 1.

<Evaluation of each toner and criterion of the evaluation>

(Preparation of developer)

Carrier 1 and the respective toners were mixed so as to set a toner concentration to 6% to give a developer (starter).

(Cleaning characteristic: BS)

Each starter was loaded to a full-color copying machine (CF900: made by Minolta K.K.). After a document having an image portion of 15% was duplicated on 30000 sheets (endurance copying), it was evaluated on the following criterion whether filming and BS (Black Spots) occurred on the photosensitive member.

◎: Neither filming nor BS was observed by a microscope (×100).

○: Neither filming nor BS was observed visually.

Δ: Filming and BS were observed visually, but they were not observed on the copied images (no problem in practical use).

×: Filming and BS occurred, and they were observed on the copied images (problem in practical use).

(Scratches on Photosensitive member: P/C scratches)

After the above-mentioned endurance copying processes, the surface of the organic photosensitive member was visually evaluated to be ranked as follows;

○: No scratches were found on the photosensitive member;

Δ: Thin fog appeared on the surface of the photosensitive member;

×: Scratches were found on the surface of photosensitive member.

(Abrasion of Photosensitive member: P/C abrasion amount)

After the above-mentioned endurance copying processes, an abrasion amount of the organic photosensitive member was measured by a layer-thickness measuring device to be ranked as follows;

○: The abrasion amount was appropriate;

Δ: The abrasion amount was slightly lower or slightly higher than the appropriate abrasion level, no problem arose in practical use;

×: The abrasion amount was much higher or much lower than the appropriate abrasion level, problems arose in practical use.

(Aggregation noise (white voids))

With respect to each of the developers, an image having a B/W of 15% was duplicated on 5000 sheets under N/N environments (20° C., 45%) (endurance copying) by using CF900. After the endurance copying processes, an entirely solid image (ID=1.2) were duplicated on three sheets of A3 paper to be evaluated based upon the following criteria. An average value of the three copies was shown as the result of evaluation. ×: image unevenness (white voids) having an ID not more than ½ of the ID of the solid image with sizes not less than 2 $nm^2$ were found;

Δ: Although no white voids were formed, cores of aggregated materials of approximately 0.3 μm with a slight reduction in the image density on the periphery thereof were found at not less than three portions;

○: Although no white voids were formed, cores of aggregated materials of approximately 0.3 μm with a slight reduction in the image density on the periphery thereof were found at less than three portions;

◎: No cores of aggregated materials was found.

(Environmental stability in toner electrification)

Measurements were made on a quantity of electrical charge in the respective developers that had been left to stand for 24 hours under L/L environments (10° C., 20%) as well as on a quantity of electrical charge in the respective developers that had been left to stand for 24 hours under H/H environments (30° C., 80%). Evaluation was made based upon the differences between them in accordance with the following criteria.

○: The absolute value of the difference was less than 5 μC/g.

Δ: The absolute value of the difference was in the range of 5 μC/g to less than 10 μC/g.

×: The absolute value of the difference was 10 μC/g or more.

Table 1 summarizes the results of the above-mentioned evaluation processes together with the conditions of the external addition agents.

TABLE 1

| | External Additive | | | | Evaluation Results | | | | |
|---|---|---|---|---|---|---|---|---|---|
| | Fluidizing Agent | Amount (part by weight) | Abrasive | Amount (part by weight) | BS | P/C scratches | P/C abrasion amount | White Voids | Environmental Stability |
| Toner 1 | H2000 (15 nm) | 1.0 | Titanium Oxide A (0.6 μm) | 0.8 | ○ | ○ | ○ appropriate | ○ | ○ |
| Toner 2 | H2000 (15 nm) | 1.0 | Titanium Oxide B (0.2 μm) | 0.8 | ○ | ○ | ○ appropriate | ○ | ○ |
| Toner 3 | Titanium Oxide (50 nm) | 1.0 | Titanium Oxide A (0.6 μm) | 0.8 | ○ | ○ | ○ appropriate | ◎ | ○ |
| Toner 4 | H2000 (15 nm) | 1.0 | Titanium Oxide A (0.6 μm) | 2.5 | ◎ | ○ | ○ appropriate | ◎ | ○ |

TABLE 1-continued

| | External Additive | | | | Evaluation Results | | | | |
|---|---|---|---|---|---|---|---|---|---|
| | Fluidizing Agent | Amount (part by weight) | Abrasive | Amount (part by weight) | BS | P/C scratches | P/C abrasion amount | White Voids | Environmental Stability |
| Toner 5 | H2000 (15 nm) | 2.5 | Titanium Oxide A (0.6 μm) | 0.8 | ○ | ○ | ○ appropriate | ◎ | Δ |
| Toner 8 | H2000 (15 nm) | 1.0 | Titanium Oxide A (0.6 μm) | 3.5 | ○ | ○ | Δ high | ◎ | Δ |
| Toner 9 | H2000 (15 nm) | 3.5 | Titanium Oxide A (0.6 μm) | 0.8 | Δ | ○ | ○ | ◎ | Δ |
| Toner 10 | H2000 (15 nm) | 3.5 | Titanium Oxide A (0.6 μm) | 3.5 | Δ | ○ | Δ high | ◎ | Δ |
| Toner 11 | H2000 (15 nm) | 0.3 | Titanium Oxide A (0.6 μm) | 0.3 | ○ | ○ | Δ low | Δ | ○ |
| Toner 6 | H2000 (15 nm) | 1.0 | Titanium Oxide C (0.8 μm) | 0.8 | ○ | X | ○ | ○ | ○ |
| Toner 7 | H2000 (15 nm) | 1.0 | Titanium Oxide D (0.5 μm) | 0.8 | Δ | X | ○ | ○ | ○ |

In the present specification, the values of the following physical properties were obtained by the following measuring methods.

(Measuring method of glass transition point Tg of resins)

The glass transition point was measured by a differential scanning calorimeter (DSC-200: made by Seiko Denshi K.K.) in which: based upon alumina as the reference, 10 mg of a sample was measured under the conditions of a temperature-rise rate of 10° C./min between 20° C. and 120° C., and a shoulder value of the main heat-absorption peak was defined as a glass transition point.

(Measuring method of softening point Tm of resins)

The softening point was measured by Flow Tester (CFT-500; made by Shimadzu Seisakusho K.K). A sample (1 $cm^3$) was melt and flowed under the conditions of small pore of die (diameter 1 mm, length 1 mm), a pressure of 20 $kg/cm^2$ and a temperature-rise rate of 6° C./min; and the temperature corresponds to ½ of the height from the flow-out start point to the flow-out completion point was taken as a softening point.

The particle size of toners was measured by Coulter Multisizer 2.

The toner of the present invention makes it possible to prevent white voids that occur on copied images, adhesion of toner components to the photosensitive member and scratches on the photosensitive member. The toner of the present invention is excellent in the environmental stability and the fluidizing properties.

What is claimed is:

1. A toner comprising:

toner particles containing a binder resin and a colorant; and an external addition agent that is admixed with the toner particles, the external addition agent comprising titanium oxide particles which are produced through a vapor-phase oxidizing method and has a number-average particle size of 0.3 to 0.7 μm.

2. The toner according to claim 1, wherein an amount of addition of the titanium oxide particles is within the range between 0.3 and 4.5% by weight to the toner particles.

3. The toner according to claim 1, wherein the titanium oxide particles are surface-treated with a hydrophobic agent to a degree of hydrophobicity of not less than 50%.

4. The toner according to claim 1, wherein the titanium oxide particles have a number-average particle size of 0.3 to 0.6 μm.

5. The toner according to claim 1, wherein the external addition agent contains metal oxide fine particles having a number-average particle size of 10 to 90 nm, the metal oxide fine particles being surface-treated with a hydrophobic agent.

6. The toner according claim 5, wherein the metal oxide fine particles have a number-average particle size of 10 to 30 nm and an amount of addition of the metal oxide fine particles is within the range between 0.1 and 4% by weight to the toner particles.

7. The toner according claim 5, wherein the metal oxide fine particles have a number-average particle size of 30 to 90 nm and an amount of addition of the metal oxide fine particles is within the range between 0.1 and 4% by weight to the toner particles.

8. The toner according to claim 1, wherein the titanium oxide particles are aggregated particles of primary particles having a primary particle size of 50 to 500 nm.

9. The toner according to claim 1, wherein the titanium oxide particles having a particle size of 1 μm or more are 5% by number or less.

10. A toner for a full-color image-forming apparatus, comprising:

toner particles containing a binder resin having a number-average molecule weight of 3000 to 6000, a ratio of weight-average molecule weight/number-average molecule weight in a range of 2 to 6, a glass transition point of 50 to 70° C. and a softening point of 90 to 110° C., and a colorant; and an external addition agent that is added to and mixed in the toner particles, the external addition agent comprising titanium oxide particles which are produced through a vapor-phase oxidizing method and has a number-average particle size of 0.3 to 0.7 μm.

11. The toner according to claim 10, wherein an amount of addition of the titanium oxide particles is within the range between 0.3 and 4.5% by weight to the toner particles.

12. The toner according to claim 10, wherein the titanium oxide particles are surface-treated with a hydrophobic agent to a degree of hydrophobicity of not less than 50%.

13. The toner according to claim 10, wherein the titanium oxide particles have a number-average particle size of 0.3 to 0.6 μm.

14. The toner according to claim 10, wherein the external addition agent contains metal oxide fine particles having a number-average particle size of 10 to 90 nm, the metal oxide fine particles being surface-treated with a hydrophobic agent.

15. The toner according claim 14, wherein the metal oxide fine particles have a number-average particle size of 10 to 30 nm and an amount of addition of the metal oxide fine particles is within the range between 0.1 to 4% by weight to the toner particles.

16. The toner according claim 14, wherein the metal oxide fine particles have a number-average particle size of 30 to 90 nm and an amount of addition of the metal oxide fine particles is within the range between 0.1 to 4% by weight to the toner particles.

17. The toner according to claim 10, wherein the titanium oxide particles are aggregated particles of primary particles having a primary particle size of 50 to 500 nm.

18. The toner according to claim 10, wherein the colorant is a pigment master batch containing of a pigment and a resin.

19. The toner according to claim 14, wherein the metal oxide fine particles have a degree of hydrophobicity of not-less than 50%.

20. The toner according to claim 10, wherein the titanium oxide particles having a particle size of 1 $\mu$m or more are 5% by number or less.

21. A toner comprising:

toner particles containing a binder resin and a colorant; and an external addition agent that is admixed with the toner particles, the external addition agent comprising rutile type titanium oxide particles which are produced through a vapor-phase oxidizing method and the external addition agent having a number-average particle size of 0.3 to 0.7 $\mu$m.

22. The toner according to claim 21, wherein the binder resin comprises a polyester resin having a number-average molecular weight of 3000 to 6000 and a ratio of weight-average molecular weight/number-average molecular weight in a range of 2 to 6.

23. The toner according to claim 22, wherein the polyester resin has a glass transition point of 50 to 70° C. and a softening point of 90 to 110° C.

24. The toner according to claim 21, wherein the external addition agent contains metal oxide fine particles having a number-average particle size of 10 to 90 nm.

25. A toner comprising:

toner particles containing a binder resin and a colorant; and an external addition agent that is admixed with the toner particles, the external addition agent comprising titanium oxide particles which are produced through a vapor-phase oxidizing method using titanium tetrachloride as a raw material and the external addition agent having a number-average particle size of 0.3 to 0.7 $\mu$m.

26. The toner according to claim 25, wherein the binder resin comprises a polyester resin having a number-average molecular weight of 3000 to 6000 and a ratio of weight-average molecular weight/number-average molecular weight in a range of 2 to 6.

27. The toner according to claim 26, wherein the polyester resin has a glass transition point of 50 to 70° C. and a softening point of 90 to 110 ° C.

28. The toner according to claim 25, wherein the external addition agent contains metal oxide fine particles having a number-average particle size of 10 to 90 nm.

* * * * *